US006119885A

United States Patent [19]

Witter

[11] Patent Number: 6,119,885

[45] **Date of Patent: *Sep. 19, 2000**

[54] TANK FOR STORING LIQUID PRODUCTS

[75] Inventor: Aldyr Witter, São Leopoldo, Brazil, Roger Witter, legal representative

[73] Assignee: Petroleo Brasileiro, S.A.-Petrobras, Brazil

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,639

[22] Filed: Jul. 24, 1997

(Under 37 CFR 1.47)

[30] Foreign Application Priority Data

Jul. 26, 1996 [BR] Brazil ..... 9603160

[51] Int. Cl.[7] ..... B65D 88/08

[52] U.S. Cl. ..... 220/567.2; 220/565; 220/4.13

[58] Field of Search ..... 220/571, 565, 220/567.2, 608, DIG. 6, 4.04, 4.12, 4.13; 222/156, 185.1

[56] References Cited

U.S. PATENT DOCUMENTS

| | | | |
|---|---|---|---|
| 2,662,664 | 12/1953 | Decker | 220/663 |
| 3,904,779 | 9/1975 | Hinds . | |
| 4,557,406 | 12/1985 | Olinger et al. | 220/DIG. 6 |
| 4,648,521 | 3/1987 | Thomas . | |
| 4,944,873 | 7/1990 | Williams . | |
| 5,127,540 | 7/1992 | Lillywhite et al. | 200/565 |
| 5,156,749 | 10/1992 | Williams . | |
| 5,226,558 | 7/1993 | Whitney et al. | 220/571 |
| 5,475,982 | 12/1995 | Laude-Bousquet . | |
| 5,615,798 | 4/1997 | Luburic et al. | 220/DIG. 6 |

FOREIGN PATENT DOCUMENTS

| | | |
|---|---|---|
| 38 13986 | 11/1989 | Germany . |
| 2 273 668 | 6/1994 | United Kingdom . |

*Primary Examiner*—Stephen Castellano
*Attorney, Agent, or Firm*—Nixon & Vanderhye PC

[57] ABSTRACT

A tank for storing liquid products, particularly a large capacity tank 1, comprises a bottom 5, whose center 6, is at a level below the level of the edge of the bottom. Drainage channels 7, consisting of a ramp 8, as floor with lateral plates 10, as sides, bring the undesirable materials to the edge of the tank where they can be drained out of the tank through drainage tubes.

9 Claims, 3 Drawing Sheets

TANK FOR STORING LIQUID PRODUCTS

FIELD OF THE INVENTION

The present invention relates to an improvement in tanks intended to store liquid products, in particular petroleum and its derivatives, and aims to introduce a more effective means of draining off undesirable materials (dense residues, sludge, water, sand, etc.) which normally accumulate at the bottom of such tanks.

BACKGROUND OF THE INVENTION

The object of the present invention is to increase the efficiency of operations to remove undesirable materials which normally accumulate at the bottom of storage tanks. It involves the use of a bottom whose center is at a level than lower that of the edges, and aims to concentrate at the center of the bottom the residues which are to be drained.

It also involves the use of a drainage channel in the form of a ramp, which runs from the center of the tank bottom to the edges. This ramp is inclined sufficiently to allow the drainage of the undesirable materials out of the tank.

STATE OF THE ART

Storage tanks are widely used in the petroleum industry and are essential to the functioning of an operational unit. They may be intended, for example, for the storage of crude oil, intermediate products and final products.

During the storage of liquid products, undesirable materials commonly appear which may have accompanied the product when it was deposited in the tank. The undesirable materials (dense residues, sludge, water, sand, etc.) are usually heavier than the product stored, and therefore tend to become deposited at the bottom of tanks.

The storage tanks currently used, particularly those having a medium and large capacity, have a cylindrical side mounted on a foundation ring. The bottom is generally in the shape of an upwardly convex cap or cone.

The lower part of the cylinder has built into it openings for cleaning and inspection. The doors for the cleaning openings are located on the side, supported on the foundation ring. This position means that the cleaning opening can be used to check the level of undesirable liquids deposited at the bottom of the tank.

This monitoring is effected by means of a level indicator located in the door of the cleaning opening. The level indicator serves to inform the operator when to drain the tank to remove the undesirable materials or when to stop the drainage, so as to prevent the stored product being inadvertently drained.

The lower part of the tanks has installed in it various drainage tubes in order to allow the passage of undesirable materials out of the storage tanks. At the outlet of each drainage tube there is a shutoff valve, which, when open, allows the drainage of the undesirable materials out of the tank.

Mixers are commonly installed in the inspection openings to homogenize the stored product. The number of mixers installed in tanks depends on their storage capacity and on the type of product which is being stored.

The mixers have the drawback of also causing the movement of the undesirable materials toward the center of the tank, taking them a long way from the drainage points. This characteristic slows down the drainage of undesirable materials, besides allowing the accumulation of the undesirable materials in areas where there are eddies caused by the mixers.

Since the bottom of the type of tank currently used usually has its center higher than the edges, the undesirable materials tend to accumulate in annular layers at the edge. However, since the entire extent of the edge of the tank is at the same level and there is no difference in level to facilitate the drainage of undesirable materials to the drainage tubes, the drainage process slows down, and this encourages the accumulation of undesirable materials at the bottom of the tanks, principally in those areas which are furthest from the drains.

The delay in the discharge of undesirable materials from the tanks causes various problems, such as loss of storage capacity of the product, corrosion of the bottom due to the accumulation of undesirable materials, stoppage of production for cleaning the storage tank or even replacing the damaged bottom of the tank, the need to paint the metal plates at the bottom of the tank to protect them against corrosion, the need to insert sacrificial anodes inside the bottom of the tank to protect against corrosion, etc.

It should be emphasized that, before painting the bottom of the tanks for storing liquid products, corrosion must be removed by means of sand-blasting or blasting with a jet of water, so that several coats of special protective paint can then be applied; this requires operations to be stopped for several days until the tank can be used again. This painting operation is quite costly.

The present invention aims to provide an improved tank for storing liquid products, particularly a large capacity tank, which solves the problems described above, saves time and reduces operational costs.

SUMMARY OF THE INVENTION

The present invention provides a tank for storing products, comprising a bottom and a side wall supported on a foundation ring below the level of the bottom, characterized in that the bottom has its center at a level lower than that of the edge of the bottom; in that an inspection opening is formed in the side wall of the tank and has a threshold; and in that a drainage channel is formed in the bottom and has a ramp extending from a higher end located at the center of the tank bottom to a lower end located below the highest level of said foundation ring and below the threshold of said inspection opening and sides extending sealingly between the ramp and the tank bottom.

This configuration aims to facilitate the drainage of undesirable materials from the tank.

BRIEF DESCRIPTION OF THE DRAWINGS

The characteristics of the present invention will be better understood from the detailed description given below, merely by way of an example, in conjunction with the accompanying drawings in which.

DETAILED DESCRIPTION OF THE INVENTION

Figure 1:
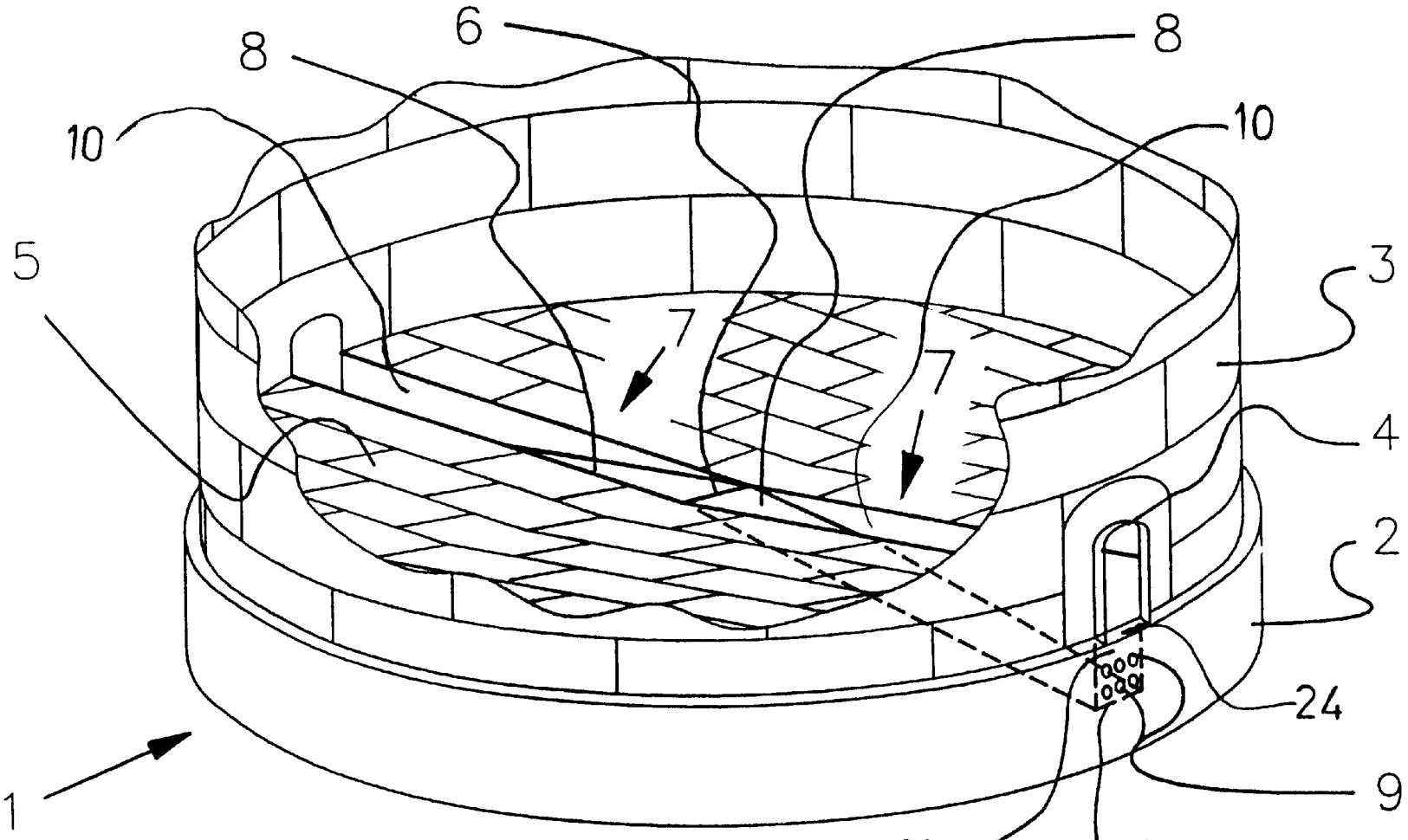
FIG. 1 is a perspective view of a first embodiment of a tank, for storing liquid products, according to the present invention.

FIG. 1 shows a perspective view of a tank 1 for storing liquid products. A foundation ring 2 serves as a plinth for supporting the cylindrical side wall 3 of the tank.

At least one access opening 4 is built into the side wall 3 of the tank, immediately above the ring 2 to allow access to the inside of the tank 1 for inspection and/or cleaning.

The access opening 4 has a level indicator, not shown in FIG. 1, whose purpose is to indicate to the operator when to drain the tank to remove the undesirable materials and when to stop the drainage to prevent the stored product itself being inadvertently drained.

In the lower part of the tank 1 there can be seen the bottom 5 which is connected to the inside of the lower part of the side wall 3. The center 6 of the bottom 5 is at a level lower than the level of the edge. The upwardly concave bottom of the tank may, for example, be a cone with its apex pointing downwards.

The difference in level between the center 6 of the tank bottom 5 and the edge aims to facilitate the movement of undesirable material toward the center 6 of the tank bottom 5.

The tank 1 has at least one drainage channel 7 (in this case two) which make it possible to remove undesirable materials from inside the tank. The floor of this channel 7 is a ramp 8 with one of its ends at the center 6 of the tank bottom 5 and the other end 23 at a lower level than the level of the threshold 24 of its respective access opening 4.

The ramp 8 is inclined sufficiently steeply to allow the drainage of undesirable materials from the center 6 toward the edge of the tank. The sides of the drainage channel 7 are defined by lateral plates 10 which rigidly connected to the ramp 8 and to the tank bottom 5. It should be emphasized that the number of drainage channels installed will depend on the storage capacity of the tank 1.

At the end of the drainage channel 7, next to the foundation ring 2, is a sealing plate 21 which is rigidly connected to the lateral plates 10 and to the ramp 8, and has the function of preventing leaks from the inside of the channel 7 to the ground which is immediately below.

Figure 3:
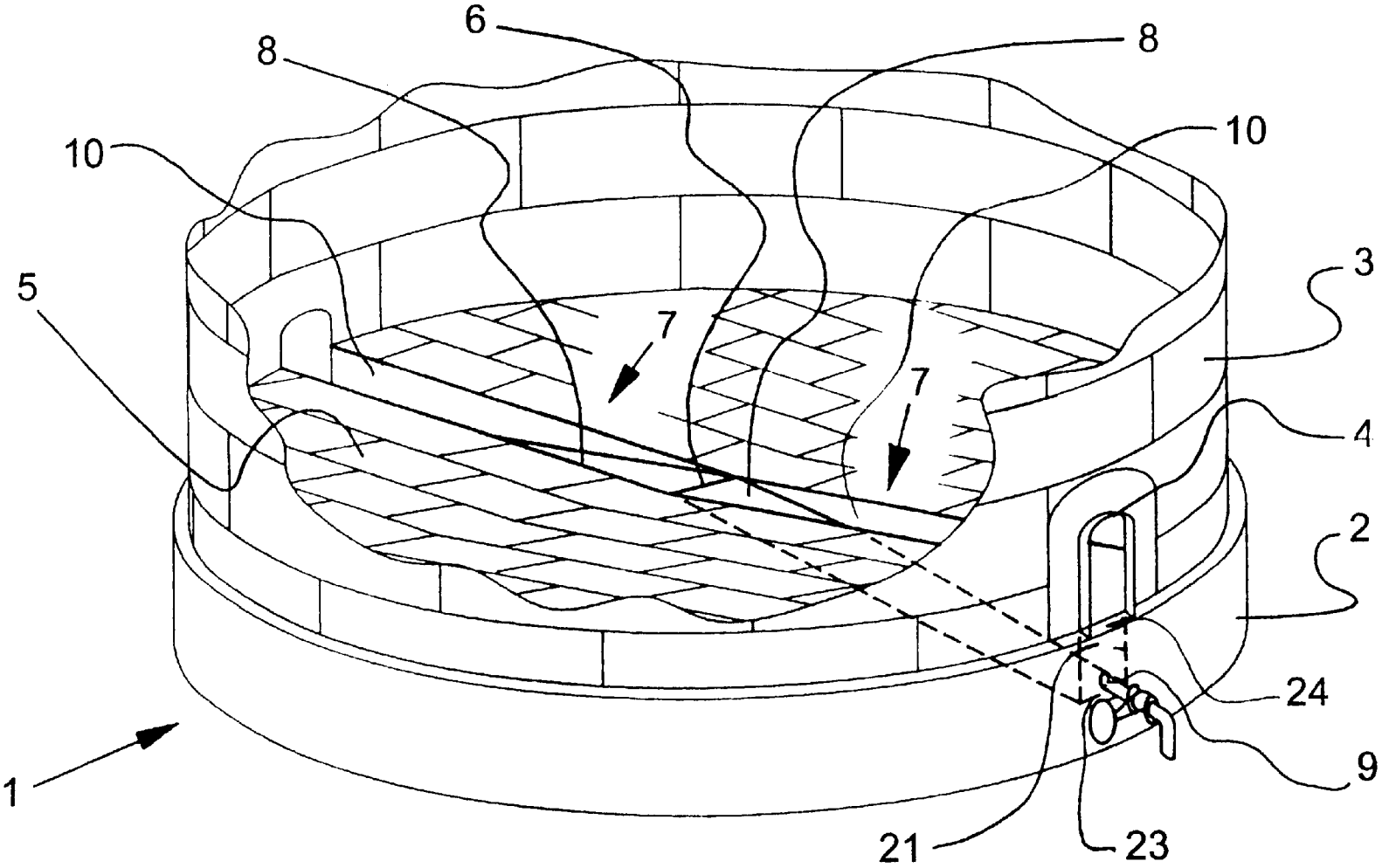
FIG. 3 is a perspective view of the first embodiment showing a shut off valve thereof.

The sealing plate 21 has at least one drain hole 9 intended to allow the passage of at least one drainage tube, not shown in the Figure. Such a drainage tube allows the drainage of undesirable materials from the drainage channel 7. The ring 2 has holes equivalent to the holes 9 in the sealing plate 21, intended to allow the passage of the drainage tubes through it. Each drainage tube has at its outlet a shut-off valve which is intended to regulate the discharge of the undesirable materials to be drained, one of which is shown in the view of FIG. 3. The use of the sealing plate 21 is optional, although advisable.

When an operator opens the shut-off valves in the drainage tubes, the undesirable materials begin to drain out of the tank 1. During drainage, the undesirable materials are guided by gravity toward the center 6 of the bottom 5. They then drain down the ramp 8 of the drainage channel 7 toward the edge of the tank bottom, where they pass into the drainage tubes and subsequently leaving the inside of the tank 1. When the level indicator indicates that the level of residues has descended to the preset limit, the operator can close the shut-off valves.

Figure 2:
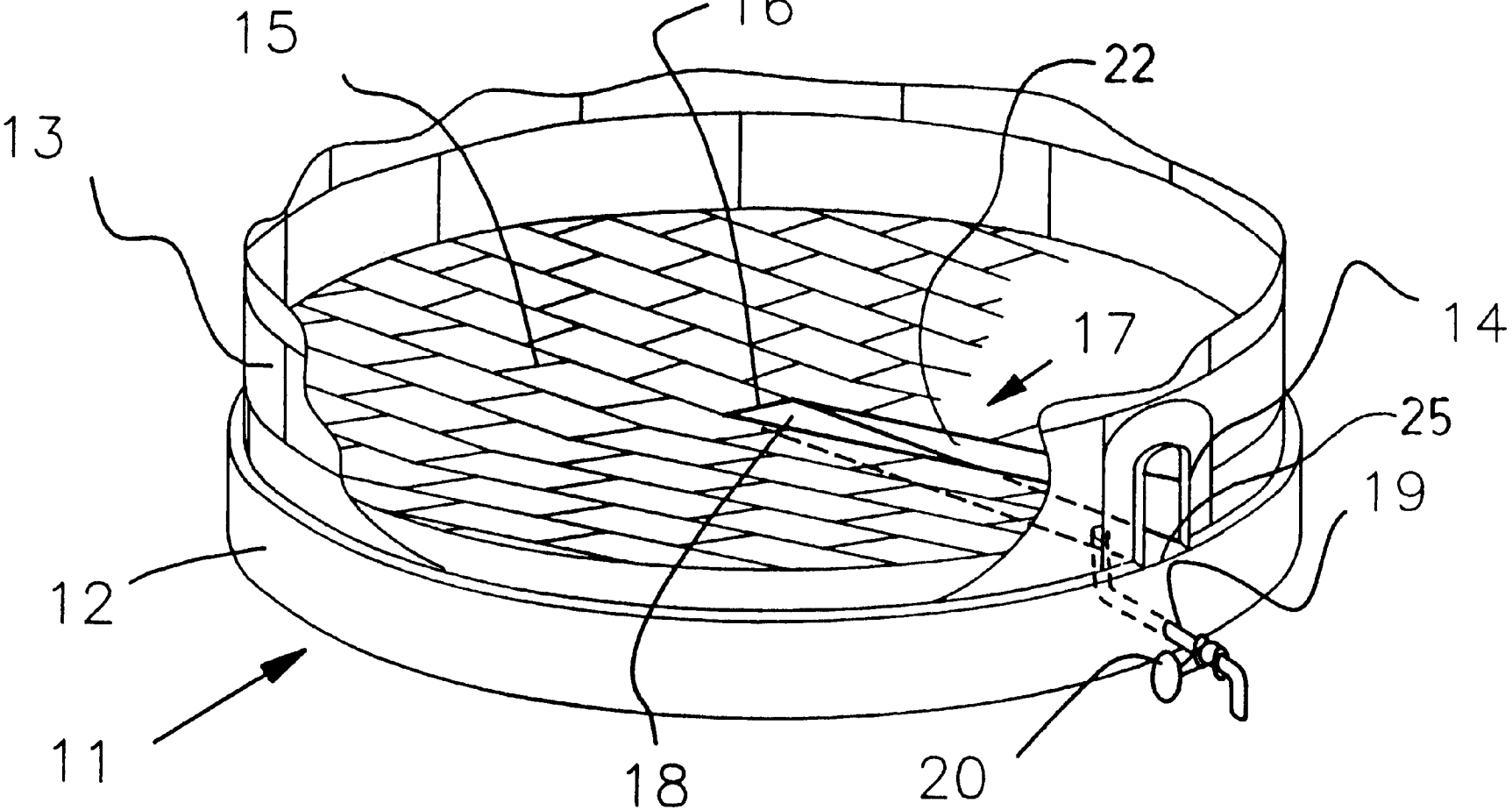
FIG. 2 is a perspective view of another embodiment of tank according to the present invention.

FIG. 2 shows a perspective view of an alternative embodiment of the present invention, applied to a tank 11 for storing liquid products. A foundation ring 12 serves as a plinth for the cylindrical side wall 13 of the tank.

At least one access opening 14 is built into the side wall 13, immediately above the foundation ring 12 to allow access to the inside of the tank 11.

The access opening 14 has a level indicator, not shown in FIG. 2, whose purpose is to indicate to the operator when to drain the tank to remove the undesirable materials or when to stop the drainage to prevent the stored product being inadvertently drained.

In the lower part of the tank 11 can be seen the bottom 15, which is connected to the inside of the lower part of the side wall 13. The center 16 of the bottom 15 is at a lower level than the level of the edge of the bottom. The upwardly concave bottom of the tank 11 may, for example, be a cone with its convex surface pointing downwards. The difference in level between the center 16 of the tank bottom 15 and the edge facilitate the movement of undesirable material toward the center 16 of the tank bottom 15.

The tank 11 has at least one drainage channel 17 which makes it possible to remove undesirable materials from inside the tank. The floor of this channel is a ramp 18 which has one of its ends at the center 16 of the bottom 15 of the tank 11 and its other end 25 adjacent to the threshold of its access opening 14.

The ramp 18 is inclined sufficiently steeply to allow the drainage of undesirable materials from the center 16 toward the edges of the tank 11. The sides of the drainage channel 17 are defined by lateral plates 22 rigidly connected to the ramp 18 and to the tank bottom 15. It should be emphasized that the number of drainage channels installed will depend on the storage capacity of the tank.

Drainage tubes are fixed to the ramp 18 of the drainage channel 17, near to the outer edge of the tank bottom 15. In FIG. 2, merely for the sake of simplicity, only one such drainage tube 19 is shown. The foundation ring 12 has holes which allow the drainage tubes to pass through it. Such drainage tube 19 has at its outlet a shut-off valve 20 which is intended to regulate the discharge of the undesirable materials to be drained.

When an operator opens the shut-off valve 20 in the drainage tube 19, drainage of the undesirable materials out of the tank 11 begins. During drainage, the undesirable materials flow by gravity toward the center 16 of the tank bottom 15 from where they then drain down along the drainage channel ramp 18, toward the edge of the bottom 15, where they pass into the drainage tubes 19, subsequently leaving the inside of the tank 11. When the level indicator indicates that the level of residues has descended to the preset limit, the operator can close the shut-off valves.

The choice between the two options presented above will depend on the available depth and on the diameter of the tank.

What is claimed is:

1. A tank for storing products, comprising:

a bottom wall;

a side wall; and a foundation ring supporting said side wall;

said bottom wall having a generally concave upper surface for facing products disposed in the tank, a center of said upper surface being defined at a vertical level lower than that of an outer peripheral edge of said upper surface;

said foundation ring being disposed at a vertical level below said outer peripheral edge of said upper surface of said bottom wall;

an inspection opening being formed in the side wall and having a threshold;

at least one draining channel formed in the bottom wall so as to have a ramp surface extending from a higher end located adjacent the center of said upper surface of said bottom wall to a lower end located at or below an upper peripheral edge of said foundation ring and at or below the threshold of said inspection opening, sides of each said drainage channel being defined to extend sealingly between the ramp surface thereof and the upper surface of the tank bottom wall, said upper surface of said bottom wall extending substantially continuously between said at least one draining channel whereby a bottom of an interior of the tank is substantially continuously concavely curved as defined by said bottom wall except at said at least one drainage channel.

2. A tank according to claim 1, wherein said ramp surface extends below the threshold of the inspection opening, said sides of each said drainage channel comprising side plates rigidly connected to extend between the upper surface of the bottom wall and the drainage channel ramp surface; and wherein a sealing plate is connected both to the side plates and to the ramp of said drainage channel, at least one drain hole being formed in the sealing plate to allow drainage from said drainage channel.

3. A tank according to claim 2, wherein at least one drainage tube communicates with said at least one drain hole and when a shut-off valve is provided at a free end of each said draining tube for controlling flow of liquid products out of the drainage channel.

4. A tank according to claim 1, wherein the lower end of said ramp surface coincides with the threshold of said inspection opening.

5. A tank according to claim 4, wherein at least one drainage tube is fixed to the ramp surface of the at least one drainage channel and passes through the foundation ring and wherein a shut-off valve is mounted to an outer end of each said drainage tube to control flow of materials out of the drainage channel.

6. A tank according to claim 1, wherein said side wall is generally cylindrical and said outer periphery edge of the bottom surface is generally circular.

7. A tank for storing liquid products, comprising a bottom and a side wall supported on a foundation ring wherein said bottom comprises:

a first upper portion forming a substantial portion of said bottom, said first upper portion having its central portion at a level lower than a level of an edge of said first upper portion;

at least one second portion forming a draining channel having a ramp and sides, said ramp extending downwardly and outwardly from a lowest point of said first upper portion to a lower end of said ramp disposed adjacent said side wall, wherein:

an access opening is formed in said side wall and has a threshold located at a bottom edge thereof;

said ramp terminates below a level of said threshold;

said sides of said draining channel comprise side plates rigidly connected to said first upper portion and to said ramp;

a sealing plate is connected to said side plates and to said ramp, said sealing plate preventing leakage from an inside of said drainage channel to the ground; and at least one draining hole is formed in said sealing plate to allow draining of said channel.

8. A tank according to claim 7, wherein:

at least one draining tube communicates with said at least one draining hole; and said at least one draining tube has at its outer end a shut-off valve for controlling the flow of materials out of said draining channel.

9. A tank for storing liquid products, comprising a bottom and a side wall supported on a foundation ring wherein said bottom comprises:

a first upper portion forming a substantial portion of said bottom, said first upper portion having its central portion at a level lower than a level of an edge of said first upper portion;

at least one second portion forming a draining channel having a ramp and sides, said ramp extending downwardly and outwardly from a lowest point of said first upper portion to a lower end of said ramp disposed adjacent said side wall, wherein:

the lower end of said ramp coincides with the threshold of an access opening formed in said side wall, at least one draining tube is fixed to said at least one drainage channel;

said at least one draining tube passes through said foundation ring; and a shut-off valve is mounted at an outer end of said at least one drainage tube for controlling the flow of products out of said drainage channel.

* * * * *

UNITED STATES PATENT AND TRADEMARK OFFICE

CERTIFICATE OF CORRECTION

PATENT NO. : 6,119,885
DATED : September 19, 2000
INVENTOR(S) : WITTER

It is certified that error appears in the above-identified patent and that said letters patent is hereby corrected as shown below:

In column 5, line 22, "when" should be --wherein--.

Signed and Sealed this

Fifteenth Day of May, 2001

*Attest:*

NICHOLAS P. GODICI

*Attesting Officer*

*Acting Director of the United States Patent and Trademark Office*